US008528801B2

(12) United States Patent
Tanaka et al.

(10) Patent No.: US 8,528,801 B2
(45) Date of Patent: Sep. 10, 2013

(54) FILM STORAGE BOX

(75) Inventors: Kousei Tanaka, Tokyo (JP); Kaori Yamada, Tokyo (JP)

(73) Assignee: Asahi Kasei Chemicals Corporation, Tokyo (JP)

( * ) Notice: Subject to any disclaimer, the term of this patent is extended or adjusted under 35 U.S.C. 154(b) by 467 days.

(21) Appl. No.: 12/664,512

(22) PCT Filed: Jun. 10, 2008

(86) PCT No.: PCT/JP2008/060582

§ 371 (c)(1),
(2), (4) Date: Dec. 14, 2009

(87) PCT Pub. No.: WO2008/153012

PCT Pub. Date: Dec. 18, 2008

(65) Prior Publication Data

US 2010/0181359 A1 Jul. 22, 2010

(30) Foreign Application Priority Data

Jun. 15, 2007 (JP) ..... 2007-159368

(51) Int. Cl.
*B65D 5/72* (2006.01)

(52) U.S. Cl.
USPC ..... 225/39; 225/43; 225/48; 225/90

(58) Field of Classification Search
USPC ..... 225/39, 43, 48–50, 80, 90, 25, 51, 225/52, 54, 77; 206/395, 397, 813
See application file for complete search history.

(56) References Cited

U.S. PATENT DOCUMENTS 1,885,996 A * 11/1932 Duffin ..... 225/19
1,917,376 A * 7/1933 Lee et al. ..... 225/43

(Continued)

FOREIGN PATENT DOCUMENTS

JP 8-113247 5/1996
JP 8-133299 5/1996

(Continued)

OTHER PUBLICATIONS

Search report from E.P.O., mail date is May 4, 2011.

(Continued)

*Primary Examiner* — Andrea Wellington
*Assistant Examiner* — Brendan Ayer
(74) *Attorney, Agent, or Firm* — Greenblum & Bernstein, P.L.C.

(57) ABSTRACT

Provided is a film storage box, more particularly, a wrap film storage box in which a grip member for lifting the edge portion of a film is lifted in advance, the lift is maintained for a long period, and the grip member is highly durable against damage. The film storage box (or the wrap film storage box) is characterized in that the grip member is formed over the entire width of the front plate of the film storage box and is lifted in a curved shape by using a repulsive force generated by adhering an edge fold strip provided at the upper end edge of the front plate to the rear surface of the front plate, and durability is imparted by employing portions of the fold lines of the both side faces of the front plate as the both side portions of the grip member.

17 Claims, 5 Drawing Sheets

(56) References Cited

U.S. PATENT DOCUMENTS

| | | | | | |
|---|---|---|---|---|---|
| 1,991,812 | A | * | 2/1935 | Marcalus | 225/43 |
| 2,115,853 | A | | 5/1938 | Hill | |
| 2,936,936 | A | * | 5/1960 | Sano | 225/43 |
| 4,549,689 | A | * | 10/1985 | Bailey | 225/49 |
| 4,582,234 | A | | 4/1986 | Marcoux | |
| 4,648,536 | A | | 3/1987 | VanderLugh | |
| 5,121,839 | A | * | 6/1992 | Lapp | 206/408 |
| 5,884,763 | A | * | 3/1999 | Ozawa | 206/397 |
| 2003/0192801 | A1 | * | 10/2003 | Yamaguchi | 206/395 |

FOREIGN PATENT DOCUMENTS

| | | |
|---|---|---|
| JP | 9-142459 | 6/1997 |
| JP | 2002-274534 | 9/2002 |
| JP | 3105742 | 11/2004 |

OTHER PUBLICATIONS

Korea Office action, mail date is Apr. 18, 2011.

A Translation of the Written Opinion of the International Searching Authority including Form PCT/ISA/237.

* cited by examiner

FILM STORAGE BOX

TECHNICAL FIELD

The present invention relates to a film storage box. In particular, the present invention can be preferably used for a food packaging wrap film.

In the following, the background art will be described by using a wrap film as an example.

BACKGROUND ART

Typically, a roll of wrap film wound on a paper core is stored in a paper rectangular-parallelepiped box, and a user cuts the wrap film to a desired length to use the wrap film. However, since a temporary holding member is generally provided on the front plate portion of a conventional wrap film storage box to prevent retraction of a remaining wrap film into the storage box, the leading edge portion of the wrap film remaining on the storage box side often clings to the front plate surface of the storage box. Also, the wrap film is made of a thin and transparent material. Thus, there is a problem that the leading edge portion of the wrap film is difficult to grasp in next use.

In order to solve the problem, there has been proposed a method for allowing a user to easily grasp the leading edge portion of a wrap film by making a hole in a portion where the wrap film is picked up or providing a cut in the portion and raising the cut forward (Patent Document 1). Also, as a method for lifting a portion of a front surface wall in advance, there has been proposed a method of forming a cut line such that its both end portions reach a fold line between a first wall and a second wall, the cut line forming a projecting member on the first wall portion of the front surface wall obtained by folding the first wall and the second wall, and utilizing a phenomenon that the first wall and the second wall will be restored to a flat state (Patent Document 2).

However, the method of making a hole described in Patent Document 1 actually has a small effect on allowing a user to easily grasp the wrap film. The leading edge portion of the wrap film may sometimes cling to a roll body inside the storage box through the hole, thereby adversely making it difficult for a user to grasp the wrap film. Also, when the cut portion is provided, there is a problem that an operation of folding and lifting the cut portion is left to a user. Furthermore, when a user picks up the leading edge portion of the wrap film together with the lifted cut portion, the storage box may be damaged from the both end portions of the cut portion and the cut portion may be torn away from the storage box. In the case of Patent Document 2, the projecting member is lifted in advance by use of the repulsive force of the material. Since the cut line of the projecting member reaches the tip portion of the front surface wall having the two walls adhered together, the projecting member is thus not torn away even when picked up together with the wrap film. The projecting member, however, can substantially freely move around the tip portion of the front surface wall as the center. Thus, when a film temporary holding member is provided on the projecting member, the projecting member is difficult to separate from the wrap film even by picking up only the wrap film, and the wrap film cannot be smoothly pulled out. Also, since the projecting member has a small width relative to the length of the front surface wall in the longitudinal direction, there is a problem that the effect of lifting the wrap film decreases when the storage box is kept for a long period of time with a lid body being closed.

Patent Document 1: Japanese Patent Laid-Open No. 08-113247

Patent Document 2: Japanese Patent Laid-Open No. 2002-274534

DISCLOSURE OF THE INVENTION

Problems to be Solved by the Invention

It is thus an object of the present invention to provide a film storage box in which a grip member that allows a user to easily grasp the leading edge portion of a film remaining on the storage box side is lifted from a front plate in advance, the lift is maintained for a long period of time, the grip member portion is not damaged even when the grip member is picked up together with the film, and the film is easily peeled from the grip member and is thereby easily pulled out even when a temporary holding member is provided on the grip member portion.

Means for Solving the Problems

In order to attain the above object, the present inventors have found that the lift height, durability, usability and the like are significantly improved by forming a grip member over the entire width of a front plate, thereby achieving the present invention.

That is, the present invention is as follows.

1. A film storage box including: a storage chamber (M) formed by each face of a front plate (1), a bottom plate (2), a rear plate (3), and side plates (4) and having an opening at an upper portion; and a lid body (N) formed by each face of a lid plate (5) connected in a direction to cover the storage chamber (M) in an openable closable manner from an upper end edge of the rear plate (3) of the storage chamber (M), a cover strip (6) extending in a direction to cover the front plate (1) from a front end edge of the lid plate (5), a tear strip (8) extending from a perforated line (7) at a top end of the cover strip (6), a cutting blade (K) provided at the top end of the cover strip (6) to cut a film and exposed by removing the tear strip (8), and cover side plates (9), wherein an edge fold strip (10) is connected to an upper end edge of the front plate (1) to cover a rear surface of the front plate (1) via a fold line (S), a cut line (P) is formed in the front plate (1) within an area overlapping the cover strip (6) when the lid body (N) is closed, over an entire width of the front plate (1) in a longitudinal direction so as not to contact the fold line (S), a grip member (Q) is formed by a portion enclosed by the fold line (S) and the cut line (P), and means for temporarily holding the film is provided on a surface of the grip member (Q).

2. The film storage box according to 1., wherein the edge fold strip (10) is adhered to the rear surface of the front plate (1).

3. The film storage box according to 1. or 2., wherein a portion of the cut line (P) closest to the bottom plate (2) overlaps the cutting blade (K) in a height direction when the lid body (N) is closed.

4. The film storage box according to any one of 1. to 3., wherein at least a center portion of the cut line (P) that is a top end portion of the grip member (Q) has a semicircular shape toward the fold line (S), the semicircular shape having a radius of 60 mm or less.

5. The film storage box according to any one of 1. to 4., wherein both end portions of the cut line (P) that is the top end portion of the grip member (Q) are semicircular cut lines toward the edge fold strip (10) or the bottom plate (2), portions of the semicircular cut lines respectively reaching both end portions of the front plate (1), and a fold line that connects the front plate (1) and an auxiliary side plate (13) at each of the both end portions of the front plate (1) is divided into an upper portion (T1) and a lower portion (T2) via a contact portion with the cut line (P), the upper portion (T1) being inclined to a center side of the front plate (1) from a tip (U) on the edge fold strip (10) side and reaching any position on each of the semicircular cut lines at the end portions of the cut line (P).

6. The film storage box according to any one of 1. to 5., wherein one or two cut lines (W) whose both ends contact the fold line (S) are provided in the edge fold strip (10), thereby each providing a projecting member (11) that faces inward into the storage chamber M when the storage box is built up.

7. The film storage box according to any one of 1. to 5., wherein one or two cut lines (W) whose outer side ends contact the fold line (S) and whose inner side ends do not contact the fold line (S) are provided in the edge fold strip (10), thereby each providing a projecting member (11) that faces inward into the storage chamber M when the storage box is built up.

8. The film storage box according to any one of 1. to 7., wherein the film is a wrap film.

Advantage of the Invention

In the film storage box according to the present invention, since the grip member is provided over the entire width of the front plate, the grip member is ensured to be kept lifted sufficiently for a long period of time in advance, thereby allowing a user to easily grasp the film leading edge portion remaining on the storage box side. Also, the grip member is connected to the both end surfaces of the front plate. Therefore, when the film clinging to the film temporary holding member provided on the grip member is peeled therefrom and pulled out, a sufficient repulsive force against the film pull-up force is obtained, and the film can be smoothly peeled since the grip member is provided over the entire width of the front plate. Furthermore, even when the grip member is picked up together with the film, the stress is spread over the entire grip member, thereby considerably reducing the possibility that the end portion of the grip member is damaged.

BRIEF DESCRIPTION OF THE DRAWINGS

FIGS. 4B and 4D illustrate examples of cut lines W that form projecting members on an edge fold strip;

FIG. 5A illustrates a state in which a grip member is lifted by a user by folding the grip member along a fold line and FIG. 5B illustrates a state in which a grip member is lifted due to a repulsive force obtained by pushing back and adhering an edge fold strip to the rear surface of a front plate.

DESCRIPTION OF SYMBOLS

Figure 1:
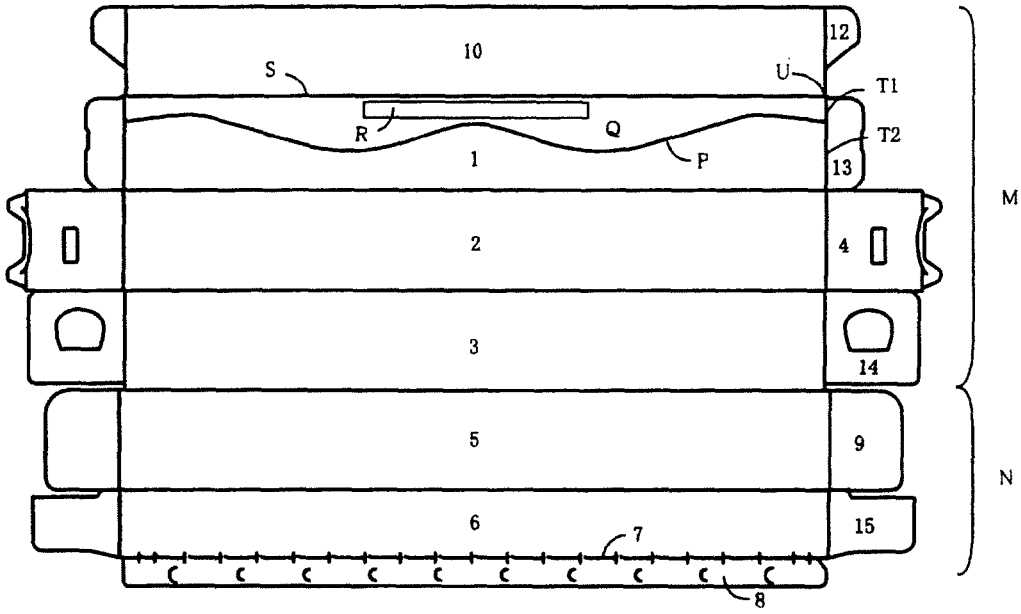
FIG. 1 is an example of developed view of a film storage box according to the present invention.

1: Front plate
2: Bottom plate
3: Rear plate
4: Side plate
5: Lid plate
6: Cover strip
7: Perforated line
8: Tear strip
9: Cover side plate
10: Edge fold strip
11: Projecting member
12: Guide member
13: Auxiliary side plate
14: Auxiliary side plate
15: Auxiliary side plate
K: Cutting blade
M: Storage chamber
N: Lid body
P: Cut line
Q: Grip member
Q': Grip member
Q": Grip member
R: Film temporary holding member
S: Fold line
S': Fold line
T1: Fold line
T2: Fold line
U: Tip portion of T1
W: Cut line

BEST MODE FOR CARRYING OUT THE INVENTION

The present invention will be described based on preferred embodiments.

FIG. 1 is an example of developed view of a film storage box according to the present invention. The developed box includes an edge fold strip 10 having guide members 12, a front plate 1 having auxiliary side plates 13, a bottom plate 2 having side plates 4, a rear plate 3 having auxiliary side plates 14, a lid plate 5 having cover side plates 9, and a cover strip 6 having auxiliary side plates 15, which are sequentially connected. The developed box further includes a tear strip 8 provided at the top end portion of the cover strip 6 via a perforated line 7, and a cutting blade K provided on the rear surface of the top end portion and exposed when the tear strip 8 is removed. The front plate 1, the bottom plate 2, the rear plate 3 and the side plates 4 define a storage chamber M. The lid plate 5, the cover strip 6, the tear strip 8, the cutting blade K, and the cover side plates 9 define a lid body N.

The auxiliary side plates 13, 14 and 15 work as glue flaps and reinforcement members, and the guide members 12 work to prevent damage to film end portions as described below. A film temporary holding member R having pressure-sensitive adhesion properties is formed on the upper portion of the front surface of the front plate 1.

Figure 2:
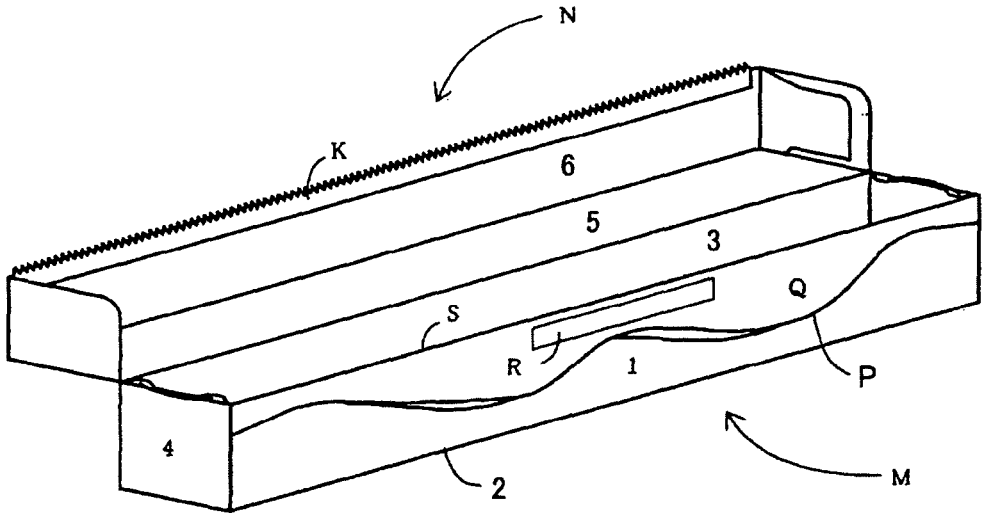
FIG. 2 is a perspective view illustrating a state in which a lid body is opened after building up the film storage box shown in FIG. 1 and removing a tear strip.
Figure 3A:
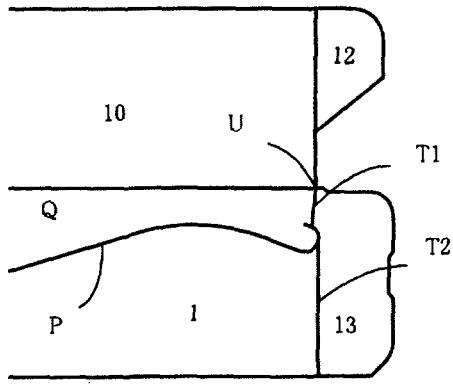
FIGS. 3A and 3B are partial views illustrating the shape of the end portion of a cut line that forms a grip member provided in a film storage box of the present invention and a fold line.
Figure 3B:
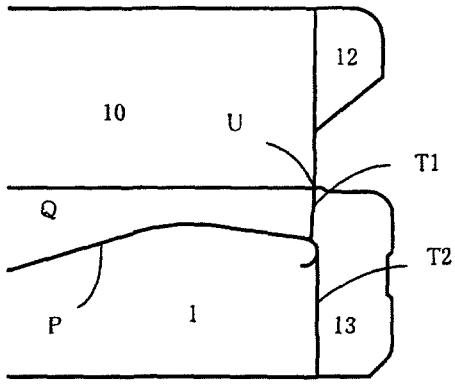
Figure 4A:
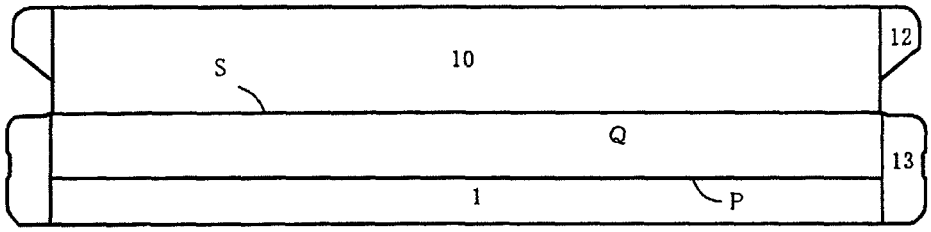
FIGS. 4A, 4B, 4C and 4D are partial views illustrating the entire shape of a cut line that forms a grip member provided in a film storage box of the present invention in other examples.
Figure 4B:
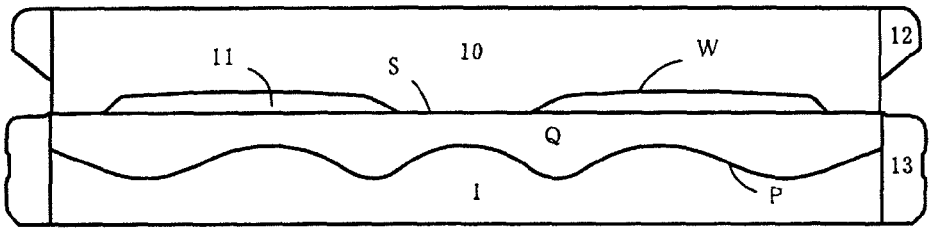
Figure 4C:
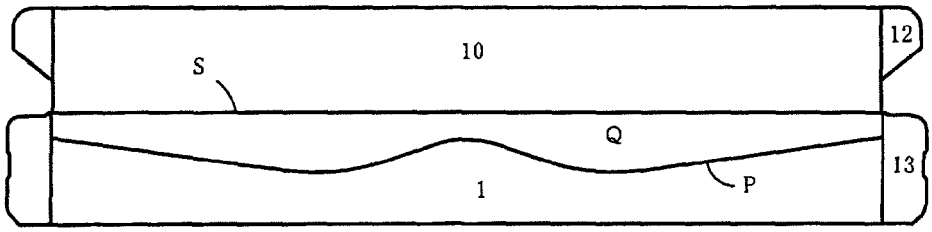
Figure 4D:
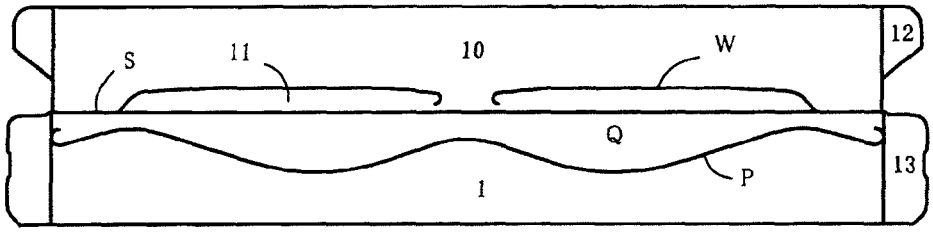
Figure 6:
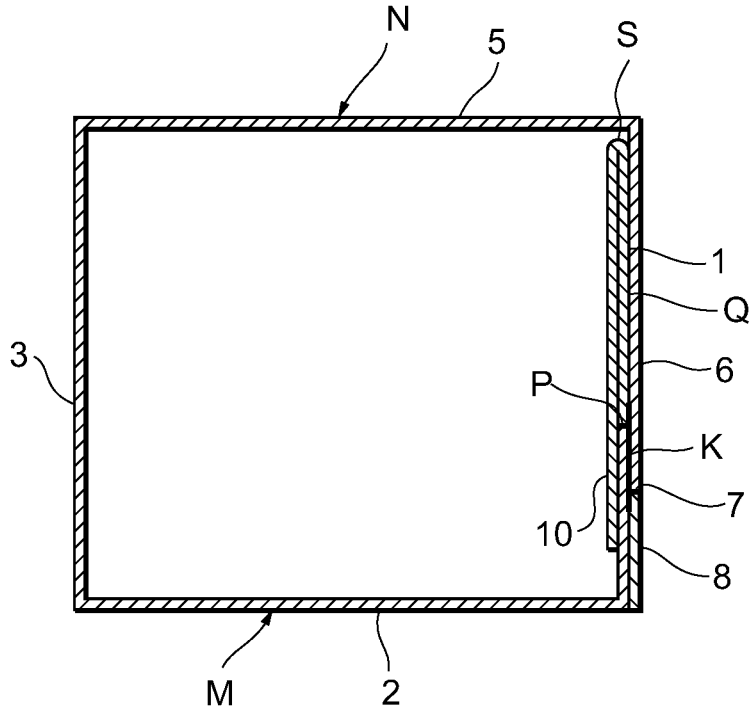
FIG. 6 is a cross sectional view of the assembled and closed film storage box a position where the cut line is closest to the bottom plate.

FIG. 2 is a perspective view illustrating a state in which the storage box shown in FIG. 1 is built up (the tear strip 8 has been removed). FIGS. 3A and 3B are partial views illustrating other examples of the shape of the end portion of a cut line P that is the top end portion of a grip member Q of the present invention and a fold line T1. FIGS. 4A to 4D are partial views illustrating other shapes of the grip member Q. In particular, FIGS. 4B and 4D illustrate examples in which two cut lines W are provided in the edge fold strip 10 to form projecting members 11. FIG. 4B illustrates an example in which the both end portions of each of the cut lines W contact a fold line S. FIG. 4D illustrates an example in which an end portion (an outer side end portion) of each of the cut lines W on the storage box end portion sides contacts the fold line S and an end portion (an inner side end portion) on the storage box center side does not contact the fold line S. FIG. 6 illustrates, by a cross-sectional view, the orientation of the edge fold strip 10 and its positioning with respect to the remainder of the film storage box in the assembled and closed state.

Figure 5A:
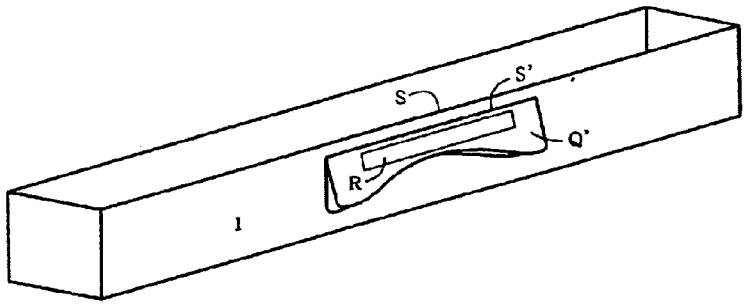
FIG.5A PRIOR ART
FIGS. 5A and 5B are perspective views illustrating only the storage chamber portion of a conventional wrap film storage box.
Figure 5B:
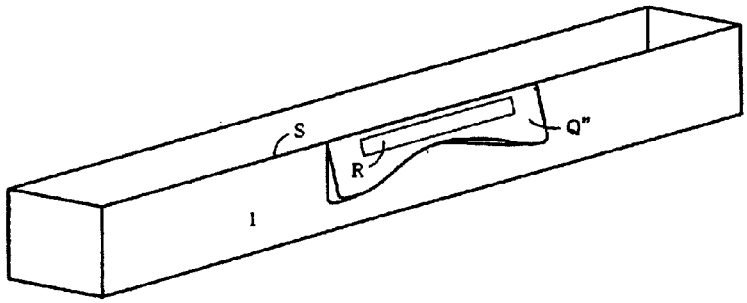
FIG.5B PRIOR ART

Furthermore, FIGS. 5A and 5B are perspective views illustrating the storage chamber portion of a film storage box having a conventional grip member.

In the film storage box according to the present invention, the cut line P that is the top end portion of the grip member Q is disposed in the front plate 1 within an area overlapping the cover strip 6 when the lid body N is closed, over the entire longitudinal direction of the front plate 1 (between the both end portions of the front plate 1) so as not to contact the fold line S. The edge fold strip 10 connected to the upper end edge of the front plate 1 is folded along the fold line S to cover the rear surface of the front plate 1. The grip member Q is thereby lifted toward the front of the front plate 1 in a curved shape in which the lift at the center portion is largest. When the edge fold strip 10 is adhered to the rear surface of the front plate 1, the grip member Q is lifted in a more preferable manner. When the edge fold strip 10 covers the rear surface of the front plate 1, the edge fold strip 10 needs to cover the front plate 1 in substantially the entire longitudinal direction, but needs to cover only half the front plate 1 in the height direction. It is more preferable to cover the front plate 1 in substantially the entire height direction in view of box stability. The magnitude of the lift changes depending on a material that constitutes the storage box, a pressing force for folding the fold line S, a distance from the fold line S to the cut line P, the length of the fold line T1 or the like. However, the tendency that the lift at the center portion of the front plate is largest does not change. Also, the grip member Q is lifted due to a repulsive force over the entire width of the front plate 1. Thus, even when the grip member Q is pressed down by an external force (for example, the grip member Q is kept pressed down by the lid body N until immediately before use), the repulsive force decreases only a little and the grip member Q can keep the lifting capability for a long period of time. Therefore, when a user pulls out a film, the user can grasp the center portion where the lift of the leading edge portion of the film remaining on the front plate 1 is largest. Also, since the lift of the film at the center portion of the front plate is largest, a user grasps the center portion of the film almost automatically. Thus, it is possible to prevent a user from pulling out the film by grasping the right or left end side of the film and thereby considerably reduce the possibility that pull-out failure occurs when the film at the end portion on the opposite side from the grasped portion is insufficiently peeled from the roll and retracts into the box.

The shape of the cut line P that forms the grip member Q provided in the film storage box according to the present invention is not specifically defined as long as the cut line P is included within the area of the front plate 1 overlapping the cover strip 6 when the lid body N is closed as shown in FIGS. 1 and 4A to 4D. However, a portion of the cut line P closest to the bottom plate 2 preferably overlaps the cutting blade K in the height direction when the lid body N is closed. In this case, it is possible to prevent the occurrence of resistance with the top end portion of the grip member Q matching (being stuck in) a step portion formed by the cutting blade K that is attached to the rear surface of the cover strip 6 when the lid body N is opened. In order to allow a user to easily grasp the film edge portion remaining on the front plate 1, a semicircular shape toward the fold line S is preferably provided at least in the center portion of the cut line P that is the top end portion of the grip member Q. The radius thereof is preferably 60 mm or less. The center portion may have any shape from the perspective of ease of grasping. However, if an inverted square-U shape or a curved line having a large curvature is formed, the portion may partially match the aforementioned step portion formed by the cutting blade K to generate resistance when the lid body N is opened.

In a case where the both end portions of the cut line P that forms the grip member Q provided in the film storage box according to the present invention are semicircular cut lines toward the edge fold strip 10 or the bottom plate 2 (that are convex toward the edge fold strip 10 or the bottom plate 2), the tip portions of the semicircular cut lines respectively reach the both end portions of the front plate 1, and a fold line that connects the front plate 1 and the auxiliary side plate 13 of the front plate 1 at each of the both end portions of the front plate 1 is divided into T1 (an upper portion) and T2 (a lower portion) via a contact portion with the cut line P, T1 may be inclined to the center side of the front plate 1 from a tip portion U on the edge fold strip 10 side and reach any position on each of the semicircular cut lines at the end portions of the cut line P (see FIGS. 3A and 3B.

By employing the inclined structure in which the top end portions of the fold lines T1 on the bottom plate 2 side are arranged on the front plate 1 side, the T1 portions are deformed toward the front of the front plate 1 when the auxiliary side plates 13 are folded to form the storage box. Accordingly, the grip member Q tends to be lifted larger. Also, by employing the semicircular shapes at the end portions of the cut line P, the stress generated when the grip member Q is picked up together with the film is spread through the semicircular portions provided at the both ends of the grip member Q. Accordingly, the grip member Q is more difficult to tear away from the end portions, and the durability is further improved. When too small, the semicircles cannot produce an effect, and when too large, the semicircles cannot be included within the front plate 1. The radius is thus preferably in a range of about 2 to 8 mm. The inclination of the fold line T1 may be appropriately selected such that the top end portion on the bottom plate 2 side contacts any position on the semicircular portion and the auxiliary side plate 13 can be smoothly folded.

It is an object of the present invention to allow a user to easily grasp the leading edge portion of the film remaining on the front plate 1 by providing the grip member Q that holds up the film on the front plate 1. As the lift of the grip member Q is larger, the film is grasped more easily. However, at the same time, the film may not be smoothly peeled from the film temporary holding member R, or if a user pulls out the film toward the bottom plate 2, the film may be difficult to pull out due to friction resistance with the film temporary holding member R.

As a method of suppressing an excessive lift of the grip member Q, one or two cut lines W whose both ends contact the fold line S are preferably provided in the edge fold strip 10 to provide the projecting members 11 that face inward into the storage chamber when the storage box is built up. The example in which the two cut lines W are provided is shown in FIG. 4B. When the storage box is built up in this case, the lift of the grip member Q is smaller than that in the case where the projecting members 11 are not provided since the repulsive force between the front plate 1 and the edge fold strip 10 adhered to each other via the fold line S acts on the projecting members 11 as well as the grip member Q. The end portion on the storage box center side of each of the cut lines W provided at two positions may be formed so not to contact the fold line S as shown in FIG. 4D. In such a case, the repulsive force acting on the grip member Q increases on the storage box center side, and degreases on the storage box end portion sides. Accordingly, while the excess lift of the grip member Q at the end portions is suppressed, a large lift can be ensured at the center portion of the grip member Q. The lift of the grip member Q depends on the material that constitutes the storage box, the pressing force for folding the fold line S, the distance from the fold line S to the cut line P, the length and inclination of the fold line T1 or the like as described above. Thus, the grip member Q may be appropriately designed in consideration of all of the above points. From the perspectives of ease of grasping the film and other operability points, the lift angle of the grip member Q with respect to the front plate 1 is preferably about 5 to 20° at the center portion where the lift angle is largest.

When the aforementioned projecting members 11 are provided, not only the effect of suppressing the excess lift of the grip member Q, but also an effect of preventing the roll from falling out of the storage chamber M, and an effect of avoiding the trouble that the film leading edge portion retracts into the storage chamber M due to some operation and thereby clings to the roll can be also obtained.

The material employed for the film storage box according to the present invention may be clay-coated newsback boards, various corrugated cardboards, plastics or the like, and is not specifically limited. It is however preferable to employ a clay-coated newsback board having a basis weight of 350 to 550 g/m$^2$ from the perspectives of productivity and cost. It is also preferable to provide known means for preventing the roll from falling out on the side surfaces (the side plates 4 or the auxiliary side plates 14) of the storage chamber M.

The material of the cutting blade K may be metal, plastics, paper (including strong fiber paper) or the like, and is not specifically limited. However, the cutting blade is preferably made of metal from the perspective of maintaining film cutting properties.

Furthermore, the material of the film temporary holding member R may be various pressure-sensitive adhesives such as acrylic, urethane, and rubber pressure-sensitive adhesives. It is however preferable to use UV-cured acrylic ester resin which expresses adhesion due to affinity with the film since the adhesion force easily decreases or the appearance is easily deteriorated due to dirt adhering thereto when the member has pressure-sensitive adhesion properties.

The guide members 12 are shown at the both end portions of the edge fold strip 10 in FIG. 1. The guide members 12 can prevent damage to the film end portions when the roll around which the film is wound is inserted from the right or left opening of the storage box obtained by folding each long side of a carton blank shown in FIG. 1 and adhering the lower end side of the front plate 1 to the rear surface of the tear strip 8 to obtain a flattened tubular body, that is, adhering the lower end side of the front plate 1 to the rear surface of the tear strip 8 in the form of a sack, and then, forming the flattened tubular body into a square shape. That is, in a case where the guide members 12 do not exist, a step is formed by the thickness of the edge fold strip 10 in the aforementioned opening on the front plate 1 side when the edge fold strip 10 is adhered to the rear surface of the front plate 1. The film end portion of the roll may come into contact with the step portion and thereby be damaged. However, the step is eliminated by providing the guide members 12, so that the film end portion is not damaged. It is therefore preferable to provide the guide members 12 on the both sides of the edge fold strip.

EXAMPLES

In the following, the present invention will be described based on examples.

Example 1

In the developed view of the film storage box shown in FIG. 1, the storage box was about 44 mm high, about 44 mm deep, and about 315 mm long. The length of the front plate 1 was 310 mm. The maximum height of the grip member Q (the length from the fold line S to the top end portion of the cut line P closest to the bottom plate 2) was 24 mm. The radius of the cutaway portion provided in the center portion was 40 mm. The height of the fold line T1 (the length from the tip portion U on the edge fold strip 10 side to the top end portion on the bottom plate 2 side) was 11 mm. The cutting blade K having a height of about 8 mm and made of tin was provided substantially over the entire top end portion of the rear surface of the cover strip 6 at a height of about 30 mm. The top end portion of the cutting blade K was made to project toward the tear strip 8 by about 2 mm. A carton blank designed as described above was made of a clay-coated newsback board having a basis weight of 450 g/m$^2$. The UV-cured acrylic ester resin whose vertical peel force according to JIS Z 0237 after adhering a polyvinylidene chloride wrap film was about 50 cN/50 mm was coated on the center portion of the grip member Q in an area having a height of 10 mm and a length of 50 mm, thereby forming the film temporary holding member R. Each face of the carton blank was folded to form the rectangular-parallelepiped storage box. The storage box was left for 24 hours, and then, the tear strip 8 was removed. The lift angle of the grip member Q (the center portion), the ease of peeling the wrap film clinging to the film temporary holding member R, and the durability of the grip member Q were evaluated based on standards described below.

Examples 2 to 11

The storage boxes were made in a similar manner to the example 1 except that the height of the fold line T1, the presence of the inclination of the fold line T1, the shapes of the both end portions of the cut line P, and the presence of the projecting members 11 were changed as shown in Table 1, and the storage boxes were evaluated.

In the case where the fold line T1 was inclined, the both end portions of the cut line P had convex semicircular shapes toward the edge fold strip 10 (the upper side), and the top end portion of T1 (on the opposite side from U) penetrated 1.5 mm into the front plate 1 to reach each of the semicircles of the cut line P. The length from the tip portion U to the top end portion on the bottom plate 2 side is described as the height in Table 1. In the examples 4 to 11, the two projecting members 11 were provided, and the maximum height of the projecting member 11 was 9 mm in every case. In the cases of the examples 4 to 7 and 9 to 11, the both end portions of the cut line W of each projecting member 11 contacted the fold line S as shown in FIG. 4B. In the case of the example 8, the inner side end portions of the cut lines W forming the projecting members 11 on the storage box center side did not contact the fold line S, and the outer side end portions of the cut lines W on the storage box end portion sides contacted the fold line S as shown in FIG. 4D.

Comparative Examples 1 to 4

The storage box according to the conventional example shown in FIG. 5A was used in the comparative examples 1 and 2. The maximum height of a grip member Q' was 24 mm, the length was 50 or 100 mm, and the distance (S−S') from the upper end portion of the front plate 1 to a fold line S' of the grip member Q' was 5 mm in the both cases as shown in Table 2 (the edge fold strip 10 connected to the upper end edge of the front plate 1 was not provided in the comparative examples 1 and 2).

The storage box according to the conventional example shown in FIG. 5B was used in the comparative examples 3 and 4. The maximum height of a grip member Q" was 24 mm, and the length was 50 or 100 mm as shown in Table 2 (the edge fold strip 10 connected to the upper end edge of the front plate 1 was provided and was folded and adhered to the rear surface of the front plate 1 in the comparative examples 3 and 4).

The storage boxes were built up and evaluated in a similar manner to the example 1.

[Evaluation Standards and Results]

Each evaluation result and whether each example has been accepted or rejected (○: accepted, x: rejected) described below are shown in Table 3.

1. Lift Angle of Grip Member

Ten storage boxes designed as described in each of the examples and comparative examples were respectively built up and the lift angle of the center portion of each of the grip members with respect to the front plate 1 was measured. A lift angle in a range of 5 to 25° was accepted from the perspectives of the operability when the wrap film is picked up with fingers and the pull-out resistance when the wrap film is pulled out toward the bottom plate 2. The average of the measurement values in each of the storage boxes is shown in Table 3 (decimal points are rounded off).

While the respective examples and the comparative examples 3 and 4 were accepted, the comparative examples 1 and 2 were rejected since the grip member was not lifted at all (the grip member Q' is not lifted only by building up the storage box and a user himself/herself needs to fold the grip member Q' along the fold line S' in the comparative examples 1 and 2).

By comparing a set of the examples 1, 4 and 9, a set of 2, 5 and 10, and a set of 3, 6 and 11, the lift angle of the grip member Q is found to be larger when the fold line T1 has a smaller height, T1 is inclined, and there is no projecting member 11 or the distance between the center portions is longer in the case where the two projecting members 11 are provided. Also, by comparing the examples 7 and 8, the lift of the grip member Q is found to be larger when the end portions of the cut lines W forming the projecting members 11 on the storage box center side do not contact the fold line S.

2. Peel Angle of Film

The wrap film was pulled out of the storage box according to each of the examples and comparative examples and was cut. The wrap film edge portion remaining on the front plate 1 was made to cling to the film temporary holding member R. The lift angle that the center portion of the grip member reached when the wrap film was next picked up and peeled from the film temporary holding member R was measured (the rounded average of the values obtained by performing the evaluation ten times is shown in Table 3).

The case in which the lift angle was less than 45° was accepted and the case in which the lift angle exceeded 45° was rejected from the perspective of ease of peeling the wrap film. From this point, the respective examples were accepted and all the comparative examples were rejected. In particular, in the comparative examples 3 and 4 in which the grip member freely moved around the fold line S that is the tip of the front plate 1, the wrap film was not peeled even when the grip member was lifted to 90°, which means the usability is very poor.

Note that the measurement was performed by folding the fold line S' of the grip member Q' in advance to adjust the lift angle to be 15° in the comparative examples 1 and 2.

3. Durability of Grip Member

The top end portion of a force gauge was pressed against the center top end portions of the grip members Q and Q' provided in the storage boxes according to the respective examples and the comparative examples 1 and 2, the load at which the grip member portion was damaged was evaluated. The measurement results are shown in Table 3. In the respective examples, the grip member was not damaged even when the grip member was lifted to 90° or more and the measurement could not be performed any further. Thus, it is shown as 30N or more. Since 10N or more is preferable from the perspective of durability, the respective examples were determined as acceptable. On the other hand, the load at which the grip member was damaged was less than 10N in the comparative examples 1 and 2, and the grip member portion was completely separated from the front plate after being damaged. Thus, the comparative examples 1 and 2 were determined as unacceptable.

Note that the measurement was not performed on the comparative examples 3 and 4 since the grip member Q" freely moves around the fold line S and there is no portion to be damaged.

The above results show that the grip member of the film storage box within the range of the present invention is sufficiently lifted in advance, the film is smoothly peeled therefrom and the grip member is highly durable.

TABLE 1

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Maximum height of grip member Q (mm) | 24 | | | | | | 25 | | | 24 | |
| Radius of cutaway portion of grip member Q (mm) | 40 | | | | | | | | | | |
| Height of fold line T1 (mm) | 11 | 24 | 11 | | 24 | 11 | 12 | | 11 | 24 | 11 |
| Inclination of fold line T1 | Not inclined | | In-clined | Not inclined | | In-clined | Not inclined | | | | In-clined |

TABLE 1-continued

| | Example | | | | | | | | | | |
|---|---|---|---|---|---|---|---|---|---|---|---|
| | 1 | 2 | 3 | 4 | 5 | 6 | 7 | 8 | 9 | 10 | 11 |
| Radius of semicircular cut line at end portion of cut line P (mm) | Not provided | | 3 | Not provided | | 3 | | | Not provided | | 3 |
| Length of projecting member 11 (mm) | Not provided | | | | | 110 | | | | 95 | |
| Distance between center portions of projecting members 11 (mm) | Not provided | | | | | 50 | | | | 80 | |

TABLE 2

| | Comparative example | | | |
|---|---|---|---|---|
| | 1 | 2 | 3 | 4 |
| Length of grip member Q' or Q'' (mm) | 50 | 100 | 50 | 100 |
| Maximum height of grip member Q' or Q'' (mm) | 24 | | | |
| Distance between fold lines S-S' (mm) | 5 | | — | |

TABLE 3

| | Lift angle (°) | Accepted or rejected | Peel angle (°) | Accepted or rejected | Durability (N) | Accepted or rejected |
|---|---|---|---|---|---|---|
| Example 1 | 18 | ○ | 40 | ○ | 30 or more | ○ |
| Example 2 | 15 | ○ | 37 | ○ | 30 or more | ○ |
| Example 3 | 22 | ○ | 42 | ○ | 30 or more | ○ |
| Example 4 | 12 | ○ | 32 | ○ | 30 or more | ○ |
| Example 5 | 10 | ○ | 28 | ○ | 30 or more | ○ |
| Example 6 | 13 | ○ | 33 | ○ | 30 or more | ○ |
| Example 7 | 11 | ○ | 30 | ○ | 30 or more | ○ |
| Example 8 | 15 | ○ | 38 | ○ | 30 or more | ○ |
| Example 9 | 13 | ○ | 38 | ○ | 30 or more | ○ |
| Example 10 | 10 | ○ | 31 | ○ | 30 or more | ○ |
| Example 11 | 15 | ○ | 40 | ○ | 30 or more | ○ |
| Comparative example 1 | 0 | X | 77 | X | 6 | X |
| Comparative example 2 | 0 | X | 73 | X | 7 | X |
| Comparative example 3 | 10 | ○ | Not peeled | X | — | — |
| Comparative example 4 | 15 | ○ | Not peeled | X | — | — |

INDUSTRIAL APPLICABILITY

The film storage box according to the present invention is preferably used as a storage box of a roll around which various films are wound, and in particular, as a food packaging wrap film storage box.

The invention claimed is:

1. A film storage box comprising:

a storage chamber which has an opening at an upper portion, and which comprises a front plate, a bottom plate, a rear plate, and side plates; and a lid body which comprises a lid plate connected to the storage chamber at an upper end edge of the rear plate of the storage chamber and configured to cover the storage chamber in an openable and closable manner, a cover strip extending in a direction to cover the front plate from a front end edge of the lid plate, and being configured to cover the front plate a tear strip extending from a perforated line at a top end of the cover strip, a cutting blade provided at the top end of the cover strip to cut a film, the cutting blade being exposed by removal of the tear strip, and cover side plates, wherein an edge fold strip is connected to an upper end edge of the front plate to cover a rear surface of the front plate via a fold line, a cut line is provided in the front plate within an area overlapping the cover strip when the lid body is closed, the cut line being positioned between the fold line of the upper end edge of the front plate and a fold line at a lower end edge of the front plate and extending over an entire width of the front plate in a longitudinal direction so as not to contact the upper end edge fold line, a grip member being that is configured by a portion between upper end edge the fold line and the cut line and is connected to the edge fold strip through the upper end edge fold line and extends towards a front side of the film storage box, the grip member including ends portions, the end portions of the grip member each being fixed to an auxiliary side plate by a side fold line at a front side of the film storage box, each auxiliary side plate being positioned at a longitudinal end of the front plate, and a holder that temporarily holds the film is provided on a surface of the grip member, the grip member extending outwardly with respect to the front plate and being configured such that a lift angle of the grip member with respect to the front of the front plate is largest at a longitudinal center portion of the grip member and is less at each end portion of the grip member.

2. The film storage box according to claim 1, wherein the edge fold strip is adhered to the rear surface of the front plate.

3. The film storage box according to claim 1, wherein a portion of the cut line closest to the bottom plate overlaps the cutting blade in a height direction when the lid body is closed.

4. The film storage box according to claim 1, wherein at least a center portion of the cut line that is a top end portion of the grip member has a semicircular shape curving toward the fold line, the semicircular shape having a radius of 60 mm or less.

5. The film storage box according to claim 1, wherein both end portions of the cut line that is the top end portion of the grip member are semicircular cut lines curving toward the edge fold strip or the bottom plate, portions of the semicircular cut lines respectively reaching both end portions of the front plate, and a fold line that connects the front plate and an auxiliary side plate at each of the both end portions of the front plate is divided into an upper portion and a lower portion via a contact portion with the cut line, the upper portion being inclined to a center side of the front plate from a tip on the edge fold strip side and reaching any position on each of the semicircular cut lines at the end portions of the cut line.

6. The film storage box according to claim 1, wherein one or two cut lines whose both ends contact the fold line are provided in the edge fold strip, thereby each providing a projecting member that faces inward into the storage chamber when the storage box is built up.

7. The film storage box according to claim 1, wherein one or two cut lines whose outer side ends contact the fold line and whose inner side ends do not contact the fold line are provided in the edge fold strip, thereby each providing a projecting member that faces inward into the storage chamber when the storage box is built up.

8. The film storage box according to claim 1, wherein the film is a wrap film.

9. The film storage box according to claim 2, wherein a portion of the cut line closest to the bottom plate overlaps the cutting blade in a height direction when the lid body is closed.

10. The film storage box according to claim 2, wherein at least a center portion of the cut line that is a top end portion of the grip member has a semicircular shape curving toward the fold line, the semicircular shape having a radius of 60 mm or less.

11. The film storage box according to claim 2, wherein both end portions of the cut line that is the top end portion of the grip member are semicircular cut lines curving toward the edge fold strip or the bottom plate, portions of the semicircular cut lines respectively reaching both end portions of the front plate, and a fold line that connects the front plate and an auxiliary side plate at each of the both end portions of the front plate is divided into an upper portion and a lower portion via a contact portion with the cut line, the upper portion being inclined to a center side of the front plate from a tip on the edge fold strip side and reaching any position on each of the semicircular cut lines at the end portions of the cut line.

12. The film storage box according to claim 2, wherein one or two cut lines whose both ends contact the fold line are provided in the edge fold strip, thereby each providing a projecting member that faces inward into the storage chamber when the storage box is built up.

13. The film storage box according to claim 2, wherein one or two cut lines whose outer side ends contact the fold line and whose inner side ends do not contact the fold line are provided in the edge fold strip, thereby each providing a projecting member that faces inward into the storage chamber when the storage box is built up.

14. The film storage box according claim 2, wherein the film is a wrap film.

15. A film storage box comprising:

a storage chamber which has an opening at an upper portion, and which comprises a front plate, a bottom plate, a rear plate, and side plates; and a lid body which comprises a lid plate connected to the storage chamber at an upper end edge of the rear plate of the storage chamber and configured to cover the storage chamber in an openable and closable manner, a cover strip extending in a direction to cover the front plate from a front end edge of the lid plate, and being configured to cover the front plate a tear strip extending from a perforated line at a top end of the cover strip, a cutting blade provided at the top end of the cover strip to cut a film, the cutting blade being exposed by removal of the tear strip, and cover side plates, wherein an edge fold strip is connected to an upper end edge of the front plate to cover a rear surface of the front plate via a fold line, a cut line is provided in the front plate within an area overlapping the cover strip when the lid body is closed, the cut line extending over an entire width of the front plate in a longitudinal direction so as not to contact the fold line, a grip member being configured by a portion between the fold line and the cut line, the grip member including ends portions, the end portions of the grip member each being fixed to an auxiliary side plate by a side fold line, each auxiliary side plate being positioned at a longitudinal end of the front plate, and a holder that temporarily holds the film is provided on a surface of the grip member, and wherein both end portions of the cut line that is the top end portion of the grip member are semicircular cut lines curving toward the edge fold strip or the bottom plate, portions of the semicircular cut lines respectively reaching both end portions of the front plate, and a fold line that connects the front plate and an auxiliary side plate at each of the both end portions of the front plate is divided into an upper portion and a lower portion via a contact portion with the cut line, the upper portion being inclined to a center side of the front plate from a tip on the edge fold strip side and reaching a position on each of the semicircular cut lines at the end portions of the cut line.

16. A film storage box comprising:

a storage chamber which has an opening at an upper portion, and which comprises a front plate, a bottom plate, a rear plate, and side plates; and a lid body which comprises a lid plate connected to the storage chamber at an upper end edge of the rear plate of the storage chamber and configured to cover the storage chamber in an openable and closable manner, a cover strip extending in a direction to cover the front plate from a front end edge of the lid plate, and being configured to cover the front plate a tear strip extending from a perforated line at a top end of the cover strip, a cutting blade provided at the top end of the cover strip to cut a film, the cutting blade being exposed by removal of the tear strip, and cover side plates, wherein an edge fold strip is connected to an upper end edge of the front plate to cover a rear surface of the front plate via a fold line, a cut line is provided in the front plate within an area overlapping the cover strip when the lid body is closed, the cut line extending over an entire width of the front plate in a longitudinal direction so as not to contact the fold line, a grip member being configured by a portion between the fold line and the cut line, the grip member including ends portions, the end portions of the grip member each being fixed to an auxiliary side plate by a side fold line, each auxiliary side plate being positioned at a longitudinal end of the front plate, and a holder that temporarily holds the film is provided on a surface of the grip member, and wherein one or two cut lines whose outer side ends contact the fold line and whose inner side ends do not contact the fold line are provided in the edge fold strip, thereby each providing a projecting member that faces inward into the storage chamber when the storage box is built up.

17. The film storage box according to claim 1, the grip member being configured such that the cut line, positioned at a free end of the grip member, extends exteriorly of the storage chamber.

* * * * *